US008391105B2

(12) United States Patent
Raymond

(10) Patent No.: US 8,391,105 B2
(45) Date of Patent: Mar. 5, 2013

(54) SYNCHRONIZATION OF A GENERATED CLOCK

(75) Inventor: Luke Raymond, Carrollton, TX (US)

(73) Assignee: Maxim Integrated Products, Inc., San Jose, CA (US)

( * ) Notice: Subject to any disclaimer, the term of this patent is extended or adjusted under 35 U.S.C. 154(b) by 483 days.

(21) Appl. No.: 12/779,756

(22) Filed: May 13, 2010

(65) Prior Publication Data

US 2011/0280109 A1 Nov. 17, 2011

(51) Int. Cl.
*G04F 5/00* (2006.01)

(52) U.S. Cl. ..... 368/46; 368/156

(58) Field of Classification Search ..... 368/46–47, 368/156

See application file for complete search history.

(56) References Cited

U.S. PATENT DOCUMENTS 5,469,409 A * 11/1995 Anderson et al. ..... 368/10
6,055,362 A * 4/2000 Kesner et al. ..... 714/1
6,252,826 B1 * 6/2001 Kaizu et al. ..... 368/120
6,944,099 B1 * 9/2005 Preuss et al. ..... 368/113
6,958,953 B2 * 10/2005 Retter et al. ..... 368/47
7,661,008 B2 * 2/2010 Retter et al. ..... 713/500

* cited by examiner

*Primary Examiner* — Sean Kayes
(74) *Attorney, Agent, or Firm* — Advent, LLP

(57) ABSTRACT

A real time clock circuit is provided that has an onboard oscillator continuously providing an internal clock frequency, which is digitally synchronized to a more accurate reference clock frequency. An exemplary real time clock inhibits synchronization of the internal clock frequency when the reference clock is unavailable or if the reference clock's frequency is outside of a defined accuracy range.

20 Claims, 3 Drawing Sheets

SYNCHRONIZATION OF A GENERATED CLOCK

CROSS-REFERENCE TO RELATED APPLICATIONS

N/A

TECHNICAL FIELD

The present invention relates generally to real-time clock circuitry and devices, and more specifically to real-time clock circuitry that uses an on-board oscillator circuit, which provides a timing signal that may be corrected or adjusted by an external reference signal when the external reference signal is available.

BACKGROUND

Real-time clocks keep track of time that humans are aware of being seconds, minutes, hours, days, months and years. Low-current, real-time clocks (RTCs) are time keeping circuits and devices that provide an extremely low standby current, that permit longer life from a power supply such as a battery or other rechargeable power supply within an electronic device. An RTC can be read by other circuits or chips that are in need of the time, amount of time passed or an alarm based on time. For example, the software within a computer may request that the microprocessor or another device read the time from the RTC's storage or registers for use by other circuits or software.

Real-time clocks require a time base, beats or a frequency in order to calculate and determine how often to tick per second. If the time base or oscillator is not accurate, then the real-time clock's time will drift relative to absolute time. Thus, a number of different types of reference signals or oscillators have been used in order to provide the beat or frequency for a real-time clock. A reference signal is generally an oscillating signal of a particular frequency that is fed into a real-time clock and used as a basis for keeping the real-time calculated by and stored in the real-time clock circuit. The most often used reference signal for an RTC is an oscillator circuit. An oscillator circuit may be part of the real-time clock circuit, separate from the real-time clock yet provide an oscillation signal to the real-time clock or be generated from an external source and provided to a real-time clock circuit. The most commonly used oscillator is a crystal oscillator, which uses a quartz crystal that is off-chip. A crystal is tuned to a predetermined oscillation frequency, for example, 32768 Hz. Depending on the quality of the crystal oscillator the frequency may vary +/−10 ppm at room temperature (or by about 5 minutes per year). Common crystal oscillators may also vary based on temperature fluctuations between −40° to 85° C. by −150 ppm or by about 79 minutes per year. The larger the +/− ppm rating of the crystal the more inaccurate the crystal oscillation is and the less expensive the crystal.

A more accurate version of a 32.768 kHz crystal oscillator is a 32 kHz TCXO (Temperature Compensated Crystal Oscillator). A TCXO uses a crystal oscillator, but incorporates circuitry that compensates for the inaccuracies of the normal 32 kHz crystal oscillator. Thus, the output oscillation frequency of a TCXO is compensated for the +/− ppm average crystal oscillator error at room temperature as well as being compensated for the −150 ppm inaccuracies due to extreme temperature ranges. A 32 kHz TCXO may achieve an accuracy of +/−2 ppm between zero and 40° C., which calculates to about one minute per year of inaccuracy. In extreme temperatures like −40° C. to 185° C. the TCXO may only be inaccurate by about +/−3.5 ppm or 1.8 minutes per year. TCXOs are more expensive than regular 32 kHz crystal oscillator devices and for many situations are not economically feasible choices.

If the timing requirements of a device do not require an extremely accurate real-time clock, then ring oscillators, LC oscillators or RC oscillators may be used in such circumstances to produce an oscillation frequency or reference frequency for a real-time clock circuit. A drawback of ring oscillators, LC oscillators and RC oscillators is that they are inaccurate over time and temperature and also consume more current than a crystal oscillator circuit.

If an external input that is a more accurate and consistent reference frequency exists in or about a device, such an external input could be utilized as an input to a real-time clock circuit and used to clock the RTC device.

In the category of external input frequencies commonly used by a real-time clock circuit, there are a variety of very accurate external frequencies available. Potential accurate timing references that could be provided to an RTC circuit include a GPS signal, a WWVB 60 kHz RF transmission signal from a radio station near Fort Collins, Colo., a power line frequency of 50 or 60 Hz or a network time signal from an accurate network time connection. Although these accurate reference signals are very useful, their continuous availability for an RTC cannot be guaranteed. Thus, a backup timing reference is often required in an RTC circuit. RTC circuits are expected to have very low power requirements during operation. These days, many complex devices that require real-time clock circuitry are hand held and battery powered devices. The less current that each RTC chip, device or circuit in the hand held product draws means that the battery will run longer. Although some circuits within a hand held device can be powered down when not being used, a real-time clock cannot be powered down because it must run all the time to keep track of time on a continuous basis. Currently, an RTC circuit is considered to be a low power circuit if it draws less than 1 microamp. Thus, it is important that any improvements to a real-time clock do not significantly increase the current draw of the overall RTC device in order to provide better timing accuracy.

Furthermore, it is important to device designers that real-time clock circuitry is simple to implement so that undue time is not required to write additional software or firmware for or to trouble-shoot real-time clock circuitry installed within a device. Prior art real-time clocks that use an external frequency reference require designers to write code or to create special circuitry that detects losses of the external reference signal power and to instruct the real-time clock to switch over from using the more accurate external reference source to using a less accurate internal reference source. Furthermore, when an external reference is being used, it is important that there be automatic switching between an external accurate reference and an internal oscillation reference (for example, an on-board 32 kHz oscillator). When switching from an external reference signal to using an internal reference, sometimes glitching occurs during the switchover. Glitching introduces observable timing errors into a real-time clock's time. The accumulation of timing errors introduced during switchovers between the use of available and unavailable external reference signals adds to the inaccuracy of the prior art real-time clocks.

Prior solutions for making real-time clock circuitry more accurate have been, as discussed above, an RTC circuit that comprises an integrated 32 kHz TCXO that can provide a +/−2-3.5 ppm accuracy. Another prior RTC solution was to provide a device that requests manual synchronization of the real-time clock circuit via a microcontroller. This solution requires a microcontroller's program to repetitively correct the RTC time based on an accurate reference. Manual synchronization, thus, requires microcontroller processing time, which may slow or detract from the other functions that the microcontroller is responsible for in a device. A third prior solution for creating a more accurate real-time clock is to use an accurate external clock reference input when such an accurate clock reference is available and then switch to an on-board crystal oscillator circuit to provide a reference signal to the RTC circuitry when the more accurate external clock reference signal is not available. Such a device adds complexity and utilizes additional current with circuitry that measures the amplitude and frequency of the external clock reference input to determine whether the external clock reference is providing a valid external reference signal or whether the RTC should be clocked using the on-board crystal oscillator. Another problem with this type of prior art solution is that when switching from using the on-board crystal oscillator to the external clock input or vis-à-vis, up to about one second of instantaneous time error can be introduced during each switching event. Such prior art devices have difficulty sensing the loss of the more accurate reference input as well as performing a switchover between using the external reference signal input and the on-board crystal oscillator reference signal without producing an observable time delay or time error in the real-time clock circuit's overall time keeping accuracy.

Thus, what is needed is an RTC circuit or device that operates on a low-current of less than about 1 microamp that is inexpensive and easy to implement into other circuitry by a device designer. Furthermore, it would be advantageous to have an RTC device that does not require microcontroller support or additional software overhead that uses microcontroller processing time. Additional circuitry should not have to be designed by the circuit designer who ultimately uses and incorporates a real-time clock device with other circuitry in order for the RTC circuit or device to work properly. Furthermore, what is needed is a real-time clock that does not double count time or generate glitches switching between two or more oscillation reference signals. Furthermore, when switching between two references, no error should be produced due to a phase difference in the reference's signals at the time of switch over. In addition, the draw backs of needing complex circuits to help determine whether an external reference signal is valid or invalid in a simple low power manner need to be overcome.

SUMMARY

Embodiments of the invention provide a real time clock circuit that has an onboard oscillator circuit that continuously provides an internal clock frequency for use by the real time clock time-keeping registers. The internal clock frequency is digitally synchronized to a more accurate external reference clock frequency. Furthermore, embodiments inhibit synchronization of the internal clock frequency with the external reference clock frequency when the external reference clock is unavailable or if the reference clock's frequency is outside of a defined accuracy range.

In other embodiments, a circuit is provided. The circuit comprises an oscillator circuit that is configured to provide an internal oscillator signal. The internal oscillator signal has internal reference pulse edges substantially at an internal reference frequency. The circuit also comprises a frequency counter that is configured to receive an external reference signal that comprises periodic pulse edges. The frequency counter also is configured to receive the internal oscillator signal. The frequency counter is configured to output a count value that represents a number of internal reference pulse edges that are counted between two reference signal periodic pulse edges. The circuit further comprises a correction signal generator that is configured to receive the count value from the frequency counter. The correction signal generator outputs an oscillator fast signal when the count value is equal to a predetermined first number and outputs an oscillator slow signal when the count value is equal to a predetermined second number wherein the predetermined first number is greater than the predetermined second number. The circuit further comprises a variable divide-by circuit that is configured to receive the oscillator fast signal, the oscillator slow signal as well as the internal oscillator signal. The variable divide-by circuit is further configured to provide a conditioned output. The conditioned output has an output frequency equal to the internal reference frequency divided by a first number when the variable divide-by circuit is in receipt of the oscillator fast signal; the conditioned output signal has an output frequency equal to the internal reference frequency divided by a second number when the variable divide-by circuit is in receipt of the oscillator slow signal; or the conditioned output has an output frequency that is equal to the internal reference frequency divided by a third number. The conditioned output signal is provided to clock/calendar registers for use in counting increments of time.

Embodiments of the invention may further include a serial bus interface circuit that is configured to connect to an external serial bus to interface external devices with the clock/calendar registers.

Additional embodiments may be provided wherein the correction signal generator further outputs a loss-of-signal (LOS) indicator when the count value received by the correction signal generator is greater than the first predetermined number or less than the second predetermined number.

In additional embodiments of the invention, the frequency counter further comprises a synchronization circuit that is configured to receive the external reference signal and the internal reference signal. The synchronization circuit, because of the asynchronous nature of the external reference signal and the internal oscillator signal, uses NAND gate flip-flops instead of transmission gate flip-flops. The NAND gate flip-flops have a narrow metastable region that decreases the probability of the circuit missing a pulse by providing a narrow set up and hold time for the flip-flops. Some embodiments pass the external reference signal through two flip-flops connected in series thereby further reducing the probability of metastable flip-flop behavior being a cause of the circuit missing an edge or pulse count of the internal oscillator signal.

Other exemplary embodiments of the invention provide a real-time clock circuit that comprises an external clock input which is adapted to receive an external clock signal. The real-time clock circuit further comprises a divider circuit which is connected to receive the external clock signal and output an external reference signal having an external reference signal frequency of a desired accuracy. The desired accuracy being the frequency accuracy of the external clock signal. The real-time clock circuit further includes an internal reference signal line that is connected to provide an internal reference signal that has an internal reference signal frequency, which is less accurate over time than the desired accuracy. In most embodiments, the internal reference signal frequency is higher than the external reference signal frequency. The real-time clock circuit further comprises a synchronization circuit having a variable divide-by circuit. The variable divide-by circuit, during each cycle of the external reference signal, divides the internal reference signal frequency by a count value to provide a conditioned output signal that has a conditioned frequency, which over time is substantially as accurate as the desired frequency. The count value is a number of internal reference signal pulses that are counted within one cycle of the external reference signal. When the external clock signal is not available, the variable divide-by circuit produces the conditioned output signal by dividing the internal reference signal frequency by a fixed number.

In some embodiments of the real-time clock circuit, the external clock signal is determined to be not available when the count value is outside of a predetermined count range.

In additional real-time clock circuits, an on-board oscillation circuit is further provided and configured to provide an oscillator output wherein the oscillator output is divided down for use as the internal reference signal.

The synchronization circuit of various exemplary real-time clock circuits comprises a frequency counter that is connected to receive the internal reference signal and the external reference signal so that the frequency counter may count the number of internal reference signal pulse edges within each cycle of the external reference signal.

In yet other embodiments of the invention, a real-time clock circuit is provided that comprises an oscillation circuit adapted to produce an oscillation signal that has an oscillation frequency. The oscillation frequency may be divided down by a divide down circuit that is adapted to receive the oscillation signal and output an internal reference signal having the divided down internal reference signal frequency. An external signal, having an external signal oscillation frequency of a desired accuracy, may be received by an exemplary real-time clock circuit and have its external signal oscillation frequency divided down by a divide circuit that is adapted to divide the external signal oscillation frequency by a selectable number and provide an external reference frequency. The internal reference signal frequency is less accurate over time than the external signal oscillation frequency. The exemplary real-time clock circuit further comprises a synchronization circuit that is adapted to receive both the internal reference signal and the external reference signal. A synchronization circuit counts a count value that equals a number of internal reference signal pulse edges that are within an external reference signal cycle. The synchronization circuit uses the count value to adjust a divisor of a variable divide-by circuit in order to produce a corrected output signal. The corrected output signal comprises a corrected output frequency that is substantially as accurate as the desired frequency.

Additionally, in some embodiments of the real-time clock circuit, when the count value is a first number, the divisor of the variable divide-by circuit is adjusted to divide the internal frequency by the first number; when the count value is a second number, the divisor of the variable divide-by number is adjusted to divide the internal frequency by the second number; or when the count value is less than the first number, greater than the second number, or between the first number and the second number, the divisor of the variable divide-by circuit is adjusted to divide the internal frequency by a third number (the first number being less than the second number while the third number is between the first number and the second number).

BRIEF DESCRIPTION OF THE DRAWINGS

For a more complete understanding, reference is now made to the following description taken in conjunction with the accompanying Drawings in which.

DETAILED DESCRIPTION

Figure 1:
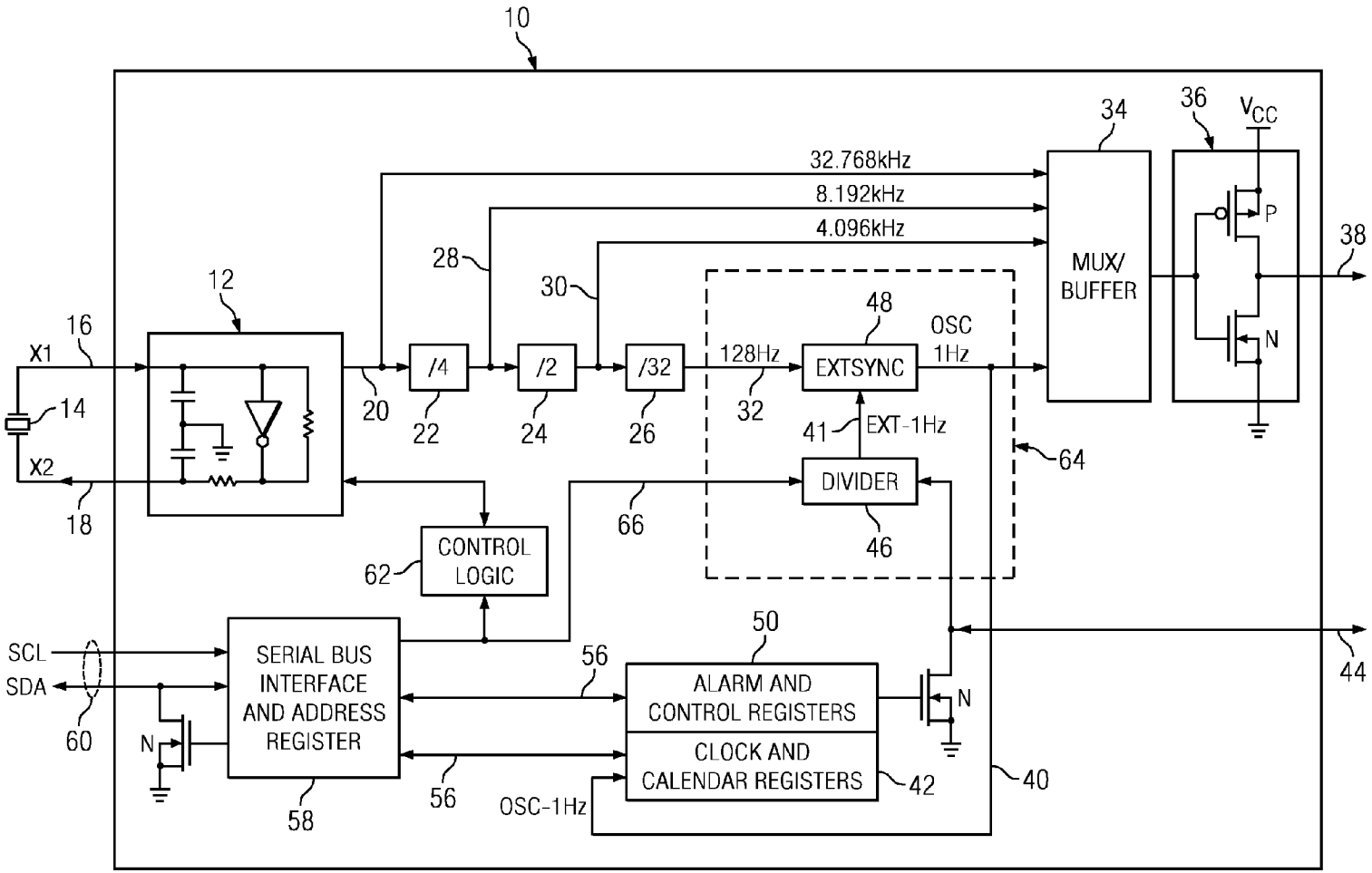
FIG. 1 depicts a functional block diagram of an exemplary RTC device.

Referring now to the drawings, wherein like reference numbers are used herein to designate like elements throughout, various views and embodiments of the exemplary synchronization of a generated clock real-time clock device are illustrated and described. Other possible embodiments are also described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Low-current, real-time clocks (RTCs) are time keeping devices that operate on an extremely low-current. By operating on an extremely low-current, exemplary RTCs help to permit a longer life from a power supply such as a battery. Some exemplary RTCs may be used with high-ESR crystals, so as to broaden the pool of useable crystals for exemplary devices. Additionally, some exemplary RTC circuits or devices may be accessed through an $I^2C$ or other serial interfaces (e.g., SPI, SM bus, 3-wire, 1-wire) in order to set time, read time, set alarms, read alarms or perform other real-time clock operations. An exemplary RTC provides clock/calendar data information that may be read in seconds, minutes, hours, days, date, month and/or year information. The date at the end of the month is automatically adjusted for months with fewer than 31 days, including corrections for leap year. Exemplary RTC devices may also operate in either 24 hour or 12 hour formats with an a.m./p.m. indicator.

Embodiments of the exemplary RTC circuits include an external clock or reference signal input that is used for synchronization. When an external reference signal (e.g., 60 Hz power line or GPS 1 pps) is present at the external reference input of an exemplary device, an exemplary RTC on-board oscillator is frequency-locked or conditioned to the external reference signal and the clock accuracy of the exemplary device is determined by the accuracy of the external reference signal source. If the external reference source becomes unavailable or is not within a predetermined accuracy, an exemplary RTC circuit uses a free running on-board oscillator circuit such as a crystal oscillator, ring oscillator, LC, RC or other available on-board oscillation signal.

An open-loop solution is utilized in embodiments of the invention. A more accurate frequency reference is input to an external reference signal input of an exemplary embodiment that also includes a 32 kHz oscillator (or other frequency oscillator) and real-time clock circuitry. If the more accurate external reference input is present, then the RTC is clocked by a divided down on-board crystal oscillator signal that is corrected or adjusted by an exemplary synchronization/divider circuit such that the real-time clock's output is as accurate as the available external clock input signal. If the external clock input signal is lost, unavailable or inaccurate, an exemplary RTC device is clocked by the on-board oscillator (32 kHz crystal oscillator or other on-board oscillation circuit).

In embodiments of the invention, the synchronization/divider circuitry utilizes a frequency counter, which introduces correction pulses into a frequency divider that feeds the adjusted output clock signal to the real-time clock. With this exemplary architecture, there is no clock acquisition shifting phase and the output clock signal frequency is corrected (in some embodiments) when the external reference clock input signal differs within one period of the on-board oscillator frequency.

Instead of switching between an external oscillation reference and an internal oscillation reference, embodiments of the invention never switch between using either the external reference or internal reference. Embodiments only use the internal or on-board reference and by doing so do not encounter prior problems of determining when to switch between the two reference signals and of introducing time error into the real-time clock's time measurement when switching between the two reference signals. Embodiments use the internal reference signal to count time, but use the external reference to condition or correct the internal reference when a correction is needed. Embodiments make a comparison between the external reference oscillation signal and the internal reference oscillation signal, wherein it may be assumed that when the external reference signal is available it is a more accurate reference signal. When the external reference is not present, the internal oscillator is allowed to continue running at its natural frequency until the external reference is present again. When the external reference is found to be present again, the external reference is again used to condition or correct the oscillation frequency, speed or accuracy of the internal oscillation signal.

Referring now to FIG. 1, an exemplary functional block diagram of a real-time clock embodiment 10 that includes a crystal oscillator and an input for an external reference signal is shown. A crystal oscillator circuit or sustaining circuit 12 is connected to an external crystal 14 via connections 16 and 18. The crystal oscillator sustaining circuit 12 causes the crystal oscillator 14 to resonate at its resonant frequency. In this embodiment, the selected resonant frequency of the crystal is 32768 Hz. Other frequencies could be used in other embodiments. The sustaining circuit 12 in some embodiments could be a basic crystal oscillator sustaining circuit, but in other embodiments could be a temperature compensated crystal oscillator sustaining circuit. The sustaining circuit 12 may not include connections to a crystal but instead be a phase lock loop oscillation circuit, a ring oscillator, an RC oscillator or an RL oscillator depending on the timing accuracy requirements of the resulting internal reference oscillation circuit and the available power for the circuit. Regardless of the type of internal or on-board oscillation circuit or sustaining circuit used, the sustaining circuit 12, in operation, operates continuously whether or not an external reference oscillation signal is being provided to the RTC device 10. In some embodiments, it is important that the oscillator circuit 12 is as low power as possible so that a battery powered or battery backed circuit is able to run as long as possible before the battery energy is drained. The use of a crystal and crystal oscillator sustaining circuit provides an inexpensive technique that provides a fairly accurate internal reference oscillation signal.

The crystal oscillator output 20, in this embodiment, is a 32768 Hz. 32768 Hz is a fairly common frequency used with real-time clocks, although a faster or slower frequency could be used in other embodiments. Whatever the crystal oscillator circuit output frequency 20 is, the oscillator output needs to be divided down to 1 Hz in order to be used by the real-time clock. In this embodiment, a series of divide-by circuits are provided to divide the oscillator output 20 down to lower frequency signals that may be used by other circuits. A divide-by 4 circuit 22 divides the 32768 Hz oscillator output 20 down to 8192 Hz 28. A divide by 2 circuit 24 divides the 8192 Hz signal down to a 4096 Hz signal 30. A divide by 32 circuit 26 divides the 4096 Hz signal 30 down to 128 Hz 32, which in this embodiment is the internal reference signal. The 32768 Hz oscillator output 20, the 8192 Hz signal 28 and the 4096 Hz signal 30 are all provided to an MUX/buffer circuit 34 so that they can be selected and provided to a square wave output circuit 36 and then output for use elsewhere via the output signal 38. In some embodiments, the series of divider circuits are not necessary and a single divide by circuit (not specifically shown) could be used to divide the oscillator output 20 frequency down to a lower frequency (internal reference signal) for use in an exemplary external synchronization circuit 48, which will be discussed in more detail below.

The plurality of frequencies (32768 Hz, 8192 Hz, 4096 Hz) are not necessary for various embodiments of the invention, but may be useful and be provided externally from an exemplary embodiment for use by other circuits nearby. These frequencies that originate from the on-board oscillator are not corrected or compensated frequency signals.

Again, at the end of the divide by circuit(s) a lower frequency signal of 128 Hz 32 is generated. The 128 Hz signal is selected as an internal reference frequency for this embodiment, but other frequencies ranging from about 2 Hz to a frequency as fast as the on device or internal oscillator 12 is providing at oscillator output 20. Selection of the divided down, low or internal reference signal frequency 32 will affect the power consumption of the overall circuit. The higher the divided down internal reference frequency the more power the circuit will use. Conversely, the lower the divided down internal reference frequency 32, the less power the circuit will use based on the fact that the higher a rate a transistor switches the more power it will consume and the lower rate a transistor switches the lower the amount of power it will consume. Furthermore, the selection of the divided down internal reference frequency 32 sets the amount of jitter that may be seen or measured in an output signal 38 when the MUX buffer is outputting the conditioned 1 Hz real-time clock signal 40. The higher the divided down low frequency 32, the less jitter seen on the conditioned 1 Hz signal 40. Conversely, the slower the frequency of the divided down signal 32, the more jitter that will be seen or measured in the conditioned 1 Hz signal 40. For purposes of embodiments of this invention, jitter is a noise or indeterminacy of the output clock edges wherein although the RTC may be operating at an accurate frequency, each clock edge, from edge to edge, may be changing the width of the output pulses, which may appear to affect the frequency. In other words, the width of the conditioned 1 Hz signal pulses may change due to jitter, but over time the frequency of the conditioned 1 Hz signal is as accurate as the external reference signal's frequency when being used. For example, if an embodiment is set such that the divided down low frequency 32 is at or around 2 Hz, the jitter on the conditioned 1 Hz signal may be of about a ½ a second, which may be visible to a human viewer and appear inaccurate even though the conditioned 1 Hz signal 40 is accurate over time. When an embodiment uses a divided down internal reference signal frequency (aka, internal reference signal) 32 of 128 Hz, the jitter found in the conditioned 1 Hz signal 40 may be as small as about 10 milliseconds (one cycle of the 128 Hz internal reference signal), which is difficult for a human to perceive if the output is somehow displayed or made audible to a user.

In various embodiments, the conditioned 1 Hz signal may provide timing for tenths, hundredths or thousands of seconds. If this is the case, such an embodiment would have the conditioned signal 40 adjusted and output to the clock and calendar registers at either 10, 100 or 1,000 Hz to provide for such a timing accuracy. The square wave output signal 38 may also provide the conditioned 1, 10, 100 or 1,000 Hz as an output.

The conditioned 1 Hz signal 40 is provided to the clock and calendar registers 42. The clock and calendar registers 42 are the "guts" of the real-time clock and is where the seconds, minutes, hours, months and years are counted, calculated and stored for use by other circuits. Thus, the resulting conditioned signal 40 is ultimately used to provide the beat or count of time for the real-time clock and calendar registers. The overall accuracy of the RTC depends on the ongoing accuracy of the conditioned signal 40.

A clock in input connection 44 can accept a 1 Hz, 50 Hz, 60 Hz or 32768 Hz external reference signal from an external source. In various embodiments, the external clock input will accept substantially any signal frequency that can be divided down to the frequency of the conditioned signal 40. The external reference signal received at the external clock input 44 is provided to the divider circuit 46, wherein the external reference signal is divided down to a frequency that is used by the synchronization circuit 48. The external clock input 44 receives the external reference signal, which is considered to be the more accurate oscillation signal of the internal oscillation circuit 12 and the external reference signal received on the external clock input 44.

In operation, the synchronization circuit 48 receives the divided down external reference 41 and the divided down internal reference frequency 32. In operation, the synchronization circuit counts the number of beats or pulses received from the divided down internal reference frequency 32 within a single cycle of the divided down external reference 41. Based on the count, the synchronization circuit can determine whether to speed up or slow down (i.e., stretch or decrease a width of a pulse or cycle) the conditioned signal 40, such that it remains accurate with respect to the received external reference. Furthermore, the synchronization circuit determines whether the received external reference signal is present and/or accurate enough. If the external reference signal is present and accurate enough, the synchronization circuit 48 uses it to condition the less accurate oscillation signal produced by the internal reference signal of the internal oscillator.

Again, the clock and calendar registers 42 receive the conditioned signal 40 to count and store seconds, minutes, hours, days, months and years in the calendar registers for use by other circuits. The associated alarm and control registers 50 provide a comparison between user set alarm, times and the clock and calendar time registers 42 such that when the clock reaches a desired alarm time a flag can be set and/or communicated from the alarm control registers 50 to other off-circuit or off-chip circuitry. Various embodiments allow the alarm control registers 50 and/or the clock and calendar registers 42 to output via a particular output pin (perhaps, for example, pin 44) on the circuit or chip or via flags that are provided via data lines 56 to a serial bus interface and address register circuit 58. The serial bus interface and address register 58 may be used by an external circuit to check the time or date stored in the clock and calendar registers 42, to set the time and date in the clock and calendar registers 42, to copy and/or check or set the alarm and control registers 50 and to determine if a specific flag or register has been set or needs to be set. In other words, the serial bus interface and address register 58 operates to enable reads and writes of flags, data, settings, alarms, time or other RTC regulated information to and from the alarm and control registers 50, the clock and calendar registers 42, the variable divider 46 and/or the control logic circuitry 62. Data lines 56 may be serial or parallel data lines. Embodiments of the invention may include a serial bus interface and address register 58 that is an $I^2C$ bus, a SPI interface circuit, SM bus circuit, 3-wire, 1-wire or other interface circuitry. Serial bus interface and address register 58 may be connected to input and output pins or lines 60 that enable the serial bus interface and address register to connect to and communicate with external circuits and devices. Such communication may include sending and receiving read or write requests for time, status, alarms or flag settings in the clock and calendar registers 42 or alarm control registers 50. Substantially any reasonable interface bus could be used via an appropriate interface bus and address register circuit 58 to read and write to the various registers and/or flags associated with the clock and calendar registers 42 as well as the alarm and control registers 50.

A control logic circuit 62, which is connected between the serial bus interface and address register circuit 58 and the on-board or internal oscillator circuit 12 may be used to turn on and off the oscillation circuit, check whether the oscillator is running or has been running continuously without any problems and in some embodiments, may be able to provide some rudimentary frequency adjustment, correction, and/or to place the on-board oscillator circuit 12 in a high power or lower power consumption mode.

A control line 66 is provided between the serial bus interface and address register 58 and the divider circuit 46 so that the divider circuit 46 can be controlled to divide the external reference signal by a selected number. The selected number may be determined by whether the external clock input 44 is receiving a 1 Hz, 50 Hz, 60 Hz, 32768 Hz or another acceptable external reference clock input. In essence, the control line 66 adjusts the divider circuit 46 to divide the external clock frequency by a selected one of a plurality of divisors.

Exemplary synchronization circuit and divider features found in embodiments of the invention are shown within the dashed area 64 of FIG. 1. These features will be explained in FIGS. 2, 3, 4 and 5.

Figure 2:
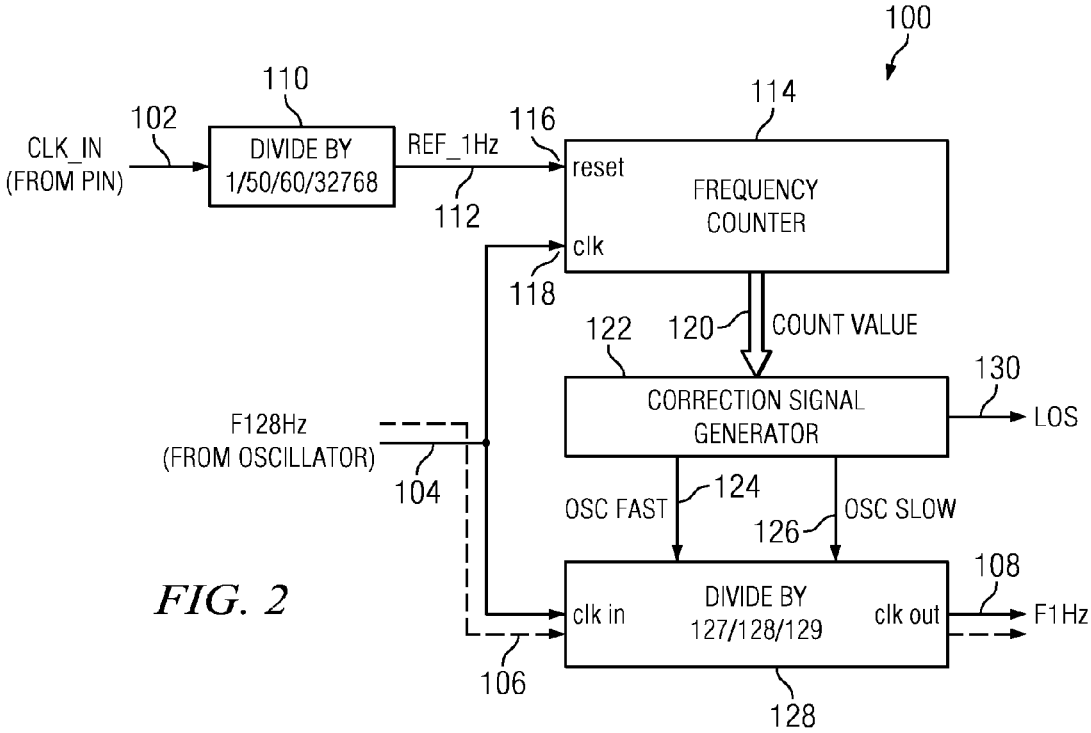
FIG. 2 depicts a functional block diagram of an exemplary synchronization divider circuit.

Referring now to FIG. 2, a functional block diagram of an exemplary synchronization circuit and divider circuit of FIG. 1 is depicted. An external reference signal is received at the external clock input 102. In some embodiments, the external clock input 102 may correspond with the external clock input 44 of FIG. 1. An internal reference signal is received at the internal oscillator signal input 104. The internal reference signal, in some embodiments, is a 128 Hz signal originated from a crystal oscillator, but in other embodiments may be a different frequency or originate from a different type of on-board internal oscillator. The internal oscillation signal input 104, in some embodiments, may correspond with the divided down internal reference frequency signal line 32 of FIG. 1. The internal reference may also be generated from an on-chip, in-circuit or on-board oscillator that produces a signal that is generally not as accurate as the external reference signal received at the external clock input 102. The dotted signal trace 106 indicates that the internal or on-board oscillator, which provides the internal reference signal, is always clocking or responsible for the output 108. In some embodiments, the external reference, received at the external clock input 102, is used to condition and correct internal reference signal timing drift and/or adjust the internal reference such that the output signal at the output 108 is substantially as accurate as the more accurate external reference signal. The external reference signal is not switched with the internal reference signal, but instead conditions the internal reference signal when the external reference signal is available and determined to be accurate to within a predetermined amount of error.

The external reference signal is input into the external clock input 102. The variable divide by circuit 110 enables embodiments of the invention to receive or accept a 1 Hz, 50 Hz, 60 Hz, 32768 Hz or other external clock frequency, which can be accurately divided down to 1 Hz. The divide by circuit 110 divides the external reference signal down to 1 Hz. In various embodiments, the divide by circuit 110 does not divide the external reference signal down to a 1 Hz signal, but instead may divide it down to another useable frequency depending on whether the real-time clock is measuring hours, minutes, seconds, tenths of seconds, hundredths of seconds or other divisions of time. A divided down reference signal 112 is output by the divide by circuit 110. While it is understood that the internal reference signal can range from 2 Hz to the output frequency of the on-board or internal oscillator, for simplicity and clarification, an embodiment that uses a 128 Hz internal reference signal input at the internal oscillator input 104 will be used as an example herein. Also, although other frequencies can be used, a 1 Hz divided down external reference signal 112 will be used in the example described herein. The 1 Hz divided down reference signal 112 is provided to a reset input 116 of a frequency counter 114. In operation, the frequency counter 114 counts the pulses of the 128 Hz internal signal which are received at the clock input 118 of the frequency counter 114. The frequency counter is reset every cycle of the 1 Hz divided down reference signal 112. Assuming for now that the external reference signal is available and accurate, the frequency counter will normally count 128 counts between each reset. When the reset signal (divided down reference signal) 112 is received, the frequency counter's count is provided as a count value 120 to the correction signal generator 122. When the count value 120 is a count of 128, then the correction signal generator 122 may not provide a correction signal to alter the variable divider circuit 128. However, the external reference, which is considered more accurate than the internal reference signal, will sometimes generate a 1 Hz reset pulse at the reset input 116 when 127 pulses or 129 pulses have been counted by the frequency counter 114. The higher or lower counts, with respect to 128, have to do with the phase shifting or drift of the 128 Hz internal reference signal with respect to the more accurate external reference signal that has been divided down to the 1 Hz divided down external reference signal 112. Thus, every so often, the frequency counter will provide a count that is one higher or one lower than the expected 128 pulse count. This will occur at a rate determined by the difference between the internal oscillation reference signal's frequency and the external reference signal's frequency.

When the count value 120, provided to the correction signal generator 122, is higher or lower than the expected 128 pulse count ("the expected count value") for the 128 Hz internal reference signal, then the correction signal generator 122 will provide a correction signal to a variable divider circuit 128. In this embodiment, the correction signal provided by the correction signal generator 122 will be either an oscillation-fast signal 124 or an oscillation-slow signal 126. The oscillation-fast signal 124 is provided when the count value 120 is 129 (or a predetermined amount higher than the expected count value), indicating that the on-board or internal reference signal is oscillating too fast by one cycle or one count (or within a predetermined number of counts) of the 128 Hz. Thus, the internal reference signal needs to be conditioned or slowed down by one cycle (or the number of counts above the expected count value) in order to correct and condition the 1 Hz output frequency 108 to be as accurate as the external frequency. Conversely, if the count value 120 is 127 (or within a predetermined number of counts lower than the expected count value), the correction signal generator 122 will provide an oscillator slow signal 126 to the variable divide by circuit 128 indicating that the internal reference signal received at the internal oscillator signal input 104 is running one count or one cycle (or the number of counts below the expected count value) too slow compared to the more accurate external reference signal. Thus, an oscillation-slow signal 126 is provided to the variable divide by circuit 128 indicating that the internal reference frequency should be conditioned or adjusted to be sped up one count or one cycle (the number of counts below the expected count value) of the internal 128 Hz reference signal to keep the 1 Hz output 108 adjusted and corrected to the more accurate external reference signal.

Explained differently, when the correction signal generator 122 does not provide a correction signal to the variable divide by circuit 128, the variable divide by circuit divides the received internal 128 Hz signal by 128 in order to produce the output 108 of 1 Hz. When the correction signal generator 122 receives a count value 120 of 129 pulses, the oscillation-fast signal 124 is provided to the variable divide by circuit so that the variable divide by circuit will divide the incoming 128 Hz internal reference signal by 129 thereby slowing or correcting the 1 Hz frequency seen at the output 108.

Conversely, when the correction signal generator 122 receives a count value 120 of 127 pulses, an oscillation-slow signal 126 is provided to the variable divide by circuit 128. In response thereto, the variable divide by circuit will divide the internal 128 Hz reference signal by 127 in order to speed up, condition or adjust the 1 Hz output frequency at the output 108 by one count or one cycle of the 128 Hz internal reference signal. In effect, the variable divide by circuit of various embodiments will slightly lengthen or slightly shorten pulses of the 1 Hz output signal seen at the output 108 depending on whether the internal oscillator is operating slightly too fast or slightly too slow, respectively. The slight lengthening or shortening of a 1 Hz output pulse at the output 108 effectively conditions and adjusts the 1 Hz output signal to accurately track the more accurate external reference signal's timing when the external reference signal is available. The adjustment is in the amount of +/− one cycle of the internal reference signal (i.e., $1/128$ or 0.0078 seconds).

When the external reference signal is not available, then there are no pulses to reset the frequency counter 114 and a loss of signal (LOS) 130 is output. Furthermore in the example being discussed, if the correction signal generator receives a count that is more than one or less than one count outside of the expected count value (i.e., 128) the correction signal generator 122 will determine that the external reference signal is either not available or is less accurate than the internal reference signal (i.e., has a drift of greater than $+/-1/128$ cycle per second). When this happens, a loss of signal (LOS) is provided on the LOS output 130 from the correction signal generator 122. When the correction signal generator has determined that there is a loss of signal, then the internal reference signal (the 128 Hz internal reference signal) is only divided by 128 in order to produce a 1 Hz output at the output 108.

In other embodiments, the variable divide by circuit 128 may instead be a variable counter such that, using the above 128 Hz internal frequency example, the correction signal generator 122 provides a signal to the variable counter 128 instructing it to count to 127, 128 or 129 before providing an output pulse at the output 108 and produce a condition or adjusted 1 Hz output.

In some embodiments, wherein the internal on-board oscillator provides an internal reference signal that is less accurate or prone to a frequency drift of more than one pulse per 1 Hz reference signal 112 pulse, then the correction signal generator 122 may accept count values ranging, for example, from 126 to 130 and thereby provide a plurality of oscillator adjustment signals to the variable divide by circuit or variable counter 128 such that the divide by ratio can be 126, 127, 128, 129 or 130. This embodiment variation can be adjusted to work for other on-board or internal reference frequency signals as well. Thus, depending on the frequency drift or inaccuracy of the internal reference frequency relative to the accuracy of the external reference frequency, embodiments of the invention may effectively add or subtract more than one pulse to the expected count value in the variable divide by circuit or variable counting circuit 128 in order to produce a conditioned or adjusted output frequency.

Similarly, if less jitter or stretching and narrowing of the output signal pulses at the output 108 is desired, a higher frequency internal reference might be used. If a higher frequency internal reference signal is used, for example 1,000 Hz, and if the variable divide by circuit only divided by 999 and 1,001 then the difference between the internal reference signal and the external reference signal could only be 0.01% before the correction signal generator would determine that there is a loss of external signal. As such, additional variable divides or counts in the variable divide by circuit 128 would be necessary to decrease the output 1 Hz signal jitter at the output 108 with a higher than 128 Hz internal oscillation frequency. Thus, the correction or conditioning of the internal reference frequency by the external reference frequency may be done in multiples of one cycle of the internal reference frequency.

The frequency counter 114 may be a 1 bit, 2 bit, 4 bit or other type of bit counter so long as the frequency counter can count to a number higher than the number of pulses received by the clock input 118 of the frequency counter between the pulses of the reference signal 112 plus the allowable number of counts above the expected value. Thus, a highly accurate external reference frequency may be utilized by embodiments of the invention to constantly correct, condition or adjust an internal reference signal so that a 1 Hz or other output frequency 108 is as accurate, over time, as the external frequency. Yet, when the highly accurate external frequency is unavailable or less accurate than a predetermined accuracy, embodiments of the invention will utilize the on-board or internal reference signal to create the 1 Hz output signal 108 until the more accurate external reference signal becomes available and is within an acceptable predetermined accuracy.

Figure 3:
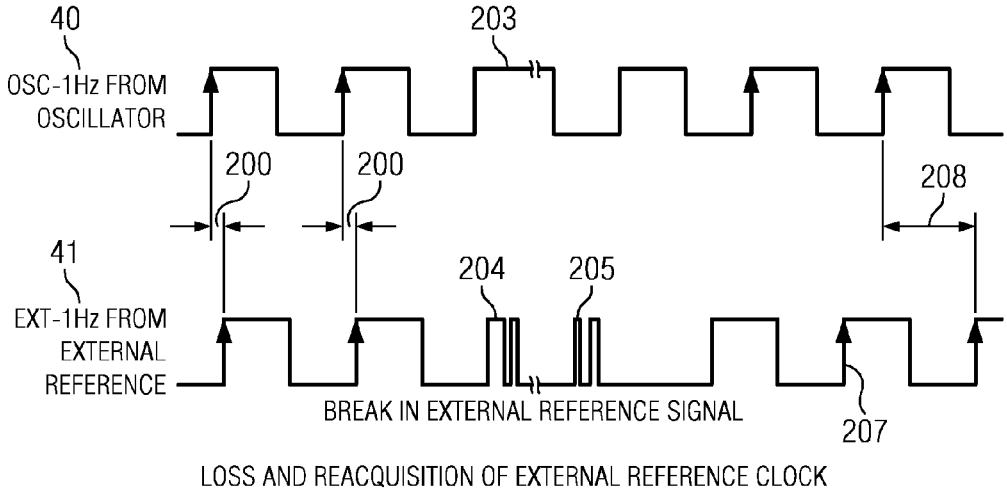
FIG. 3 depicts a timing diagram of possible external and internal reference signals in accordance with an embodiment.

Referring now to FIG. 3, a timing diagram of possible external and internal reference signals is shown. An exemplary 1 Hz conditioned output signal 40 (which may correspond to the output signal on the output 108) is shown relative to a divided down external reference signal 41 of 1 Hz (which may, in some embodiments, correspond with the reference signal 112 of FIG. 2). The corrected or conditioned 1 Hz signal 40 is a signal that comes out of the synchronization circuit 48 and is provided to the RTC clock and calendar registers 42 or to an external pin, such as output 38, on a chip. As can be seen in FIG. 3, the conditioned output signal 40 has its frequency corrected by the divided down external signal 41, but it does not have to be synchronized, as far as the signal edges are concerned, to the divided down external reference signal 41. Thus, unlike a PLL, wherein the phases of two signals are being aligned, embodiments of the invention operate with the two signals out of phase or alignment. For example, if there is a skew or a phase difference 200 between the conditioned output signal 40 and the divided down external signal 41, embodiments of the invention will operate to maintain the skew 200 for as long as the external reference is available and within the acceptable predetermined accuracy. In other words, the skew 200 between the conditioned output signal 40 and the divided down external signal 41 is maintained during the time that the internal reference signal from the internal oscillator is synchronized with or conditioned by the more accurate external reference signal. Since embodiments of the invention do not try to eliminate or pull the skew 200 between the signals back into alignment such that no skew exists between the two signals, no phase shift or timing error is introduced into the conditioned output signal that is used by, for example, the clock and calendar registers 42.

Still referring to FIG. 3, at some point in time during operation, the divided down external signal 41 is shown to be glitchy and/or lost at 204. While the signal is lost 203, an LOS signal is provided at the LOS output 130 and the correction signal generator 122 does not set or provide any correction signals to the divide by circuit 128. Thus, during this time the internal oscillator is divided down appropriately to provide an unconditioned output signal at the output 108. At 205 the divided down external signal 41 begins to reappear such that by 207 the correction signal generator 122 has determined that the count value 120 is once again within an acceptable predetermined range. At this time, the output signal 108 is again conditioned via an exemplary synchronization circuit to produce the conditioned output signal 40. Note that the skew 208 between the conditioned output signal 40 and the divided down external signal 41 can be different than the skew 200 between the two signals each time the external reference is lost and regained. Since embodiments of the invention accept and do not attempt to change or adjust the differing phase shifts or skew between the divided down external signal 41 and the conditioned output signal 40 when conditioning the output signal with the external reference signal and not conditioning the output signal with the external reference signal, instantaneous time errors are not introduced during the use or non use of the divided down external signal 41 for conditioning the internal oscillator's internal reference signal. Thus, regardless of the skew or phase shift between the edges of a divided down external signal 41 and a conditioned output signal 40, embodiments of the invention operate to accept the skew or phase shift between the two signals at whatever phase difference exists while the divided down external signal 41 remains available and within the predetermined accuracy range. Thus, embodiments of the invention do not effectively add or subtract time to the RTC due to differences in phases of the internal oscillator reference frequency and the external reference frequency. Embodiments do not add or lose time like prior art devices because embodiments do not switch between using an internal oscillator reference signal and an external reference signal. Embodiments of the invention continuously use the internal reference signal, but adjust or condition the internal reference signal when a more accurate external reference signal is available.

Figure 4:
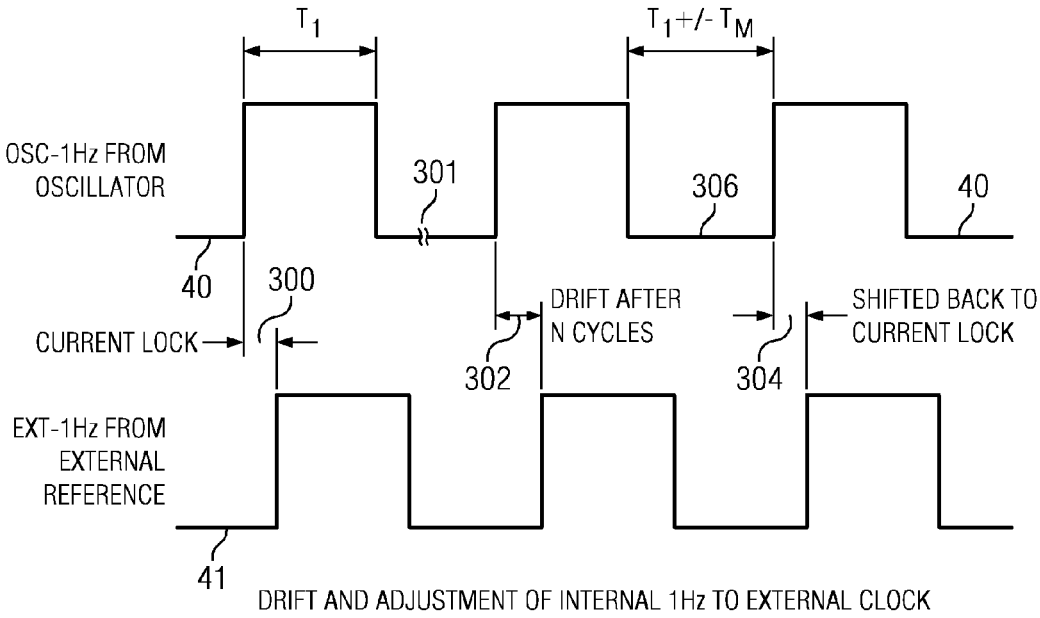
FIG. 4 depicts a timing diagram showing drift and adjustment of an exemplary internal 1 Hz signal with respect to an external reference signal.

Referring now to FIG. 4, a timing diagram of an exemplary correction or conditioning of a conditioned output signal 40 with respect to a divided down external signal 41 is shown. FIG. 4 may be considered a subset of FIG. 3 wherein FIG. 4 focuses on the correction or conditioning of the conditioned output signal 40. In the first clock or pulse of the signals a phase shift or skew 300 is seen between the conditioned output signal 40 and the divided down external signal 41. The phase shift or skew 300, plus or minus a predetermined number of internal reference signal cycles, is essentially locked or maintained by embodiments while the divided down external signal 41 is available and within a predetermined tolerance. Over time 301 the two signals 40, 41 will drift relative to each other. Thus, the phase shift 300 between the two signals will change over time or after N cycles. The variable divider circuit 128 can only add or subtract pulses of a predetermined size/amount of time to or from the conditioned output signal 40. The predetermined size/amount of time may be a multiple of one cycle of the internal reference signal (e.g., 128 Hz). Thus, the correction added or subtracted, when using an exemplary 128 Hz internal reference frequency, is a pulse width of one cycle or 1/128 of a second, which corresponds to about 7.8 milliseconds or about 0.8% of a 1 Hz signal. Until the skew 302 between the two signals drifts such that a phase shift or skew 302 of approximately +/−7.8 milliseconds accumulates, no adjustment by the variable divide by circuit 128 is made to the conditioned output signal 40. Once the skew 302 reaches or drifts to approximately +/−7.8 milliseconds an adjustment is made by adding or subtracting one pulse of the 128 Hz (about 7.8 milliseconds) to the width of the conditioned output signal 40 such that the resulting skew 304 between the conditioned output signal and the divided down external signal 41 is substantially the same as the locked in skew 300 that was determined when the external reference signal was considered available and accurate by an exemplary correction signal generator 122. The amount of granularity or the time of one count pulse of the divided down low frequency or jitter setting frequency 32 may also be referred to as a maximum amount of allowable error before correction of the conditioned output signal 40. In various embodiments of the invention, the conditioned output signal 40 is a conditioned 1 Hz signal that may be used by the real-time clock and calendar registers. In other words, embodiments of the invention lock to or accept a phase difference or skew 300 between a conditioned output signal 40 and a divided down external signal 41. At a later time 301, there may be drift between the two signals 40, 41, but until the drift 302 between the two signals is equal to or larger than the granularity or the maximum allowable error, no adjustment is made to adjust or condition the conditioned output signal 40. After the drift, skew or phase shift 302 has accumulated to at least the granularity or maximum allowable error, the conditioned output signal may be adjusted by +/− the maximum allowable error amount such that the phase difference or skew 304 between the conditioned output signal 40 and the divided down external signal 41 is substantially equal to the previous locked or maintained shift or skew 300 between the two signals. In some embodiments, the maximum allowable error is substantially equal to a predetermined multiple of one cycle of the internal reference signal or the time associated therewith. In the example provided, the predetermined multiple is equal to 1.

Still referring to FIG. 4 and assuming in this embodiment a 50% duty cycle on the conditioned output signal 40, time $T_1$ is an amount of time of an unadjusted output signal pulse while an adjusted pulse 306 has a time of $T_1$+/− the maximum allowable error time ($T_M$), which will correct the conditioned output signal's frequency to remain substantially as accurate as the external reference frequency.

Figure 5:
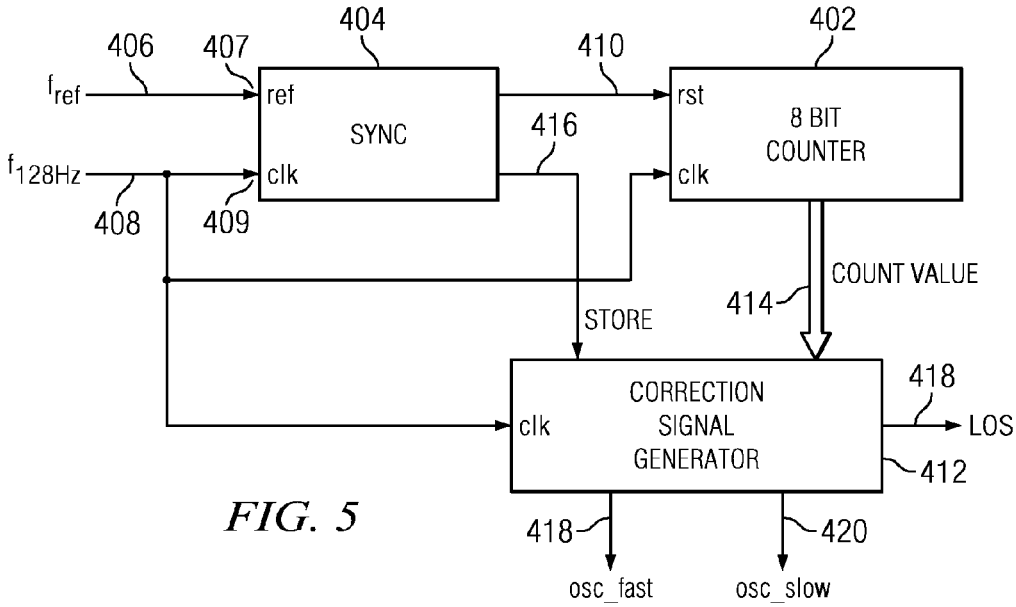
FIG. 5 depicts a functional block diagram of another exemplary synchronization portion of an exemplary embodiment.

Referring now to FIG. 5, another functional block diagram of an embodiment of a synchronization portion of an exemplary real-time clock circuit is shown. For some embodiments, FIG. 5 may be a more detailed view of the frequency counter 114 and correction signal generator 122 of FIG. 2. Regardless, the embodiment shown has an 8 bit counter 402, which can count to 256 and will easily allow the counter to count the 128 pulses of the internal reference signal as well as be able to determine if the pulse/frequency count is 129 or greater. In operation, the external reference signal is provided to the external reference signal input 406 and input to the synchronization circuit 404 as the reference signal 40. The external reference signal may correspond to the divided down external reference signal 41 of FIG. 2. An exemplary internal reference signal of, for example, 128 Hz, is provided at internal reference signal input 408 and to the clock input 409 of the synchronization circuit 404. The divided down external reference signal on the external reference signal input 406 and the internal reference signal on internal reference signal input 408 are asynchronous signals. Since these two signals are asynchronous and their pulse edges may be very close to one another, it may be impossible to always meet the longer set up and hold time requirements for standard flip-flops that could be used in the synchronization circuit 404 or counter circuit 402. In other words, the set up and hold times for a standard CMOS transition gate style flip-flop may be too long for the synchronization or counter circuits to recognize very close rising or falling edges of the two signals. As such, embodiments of the invention use a series of positive and negative edge triggered flip-flops such that the divided down external reference signal is sampled and the internal reference signal can clock the circuitry without violating any set up and hold times that the 8-bit counter 402 may have. These positive and negative edge flip-flops are connected in series to be able to recognize very close reference and clock signal edges that the exemplary sync circuit 404 may receive when the edges of the two clock signals are very close to each other. In other words, the sync circuit 404 samples the divided down external reference via reference input 406 using the internal reference signal (e.g., the 128 Hz internal reference signal) at the clock input 408 and produces a reset signal 410 and store signal 416 to control the frequency counter 402 and correction signal generator without missing a single edge regardless of how close or distant the reference input 407 and clock input 409 pulse edges are to each other in time. The synchronization circuit 404 produces a synchronous reset signal 410 which resets the 8-bit counter 402 back to zero at, for example, every 1 Hz pulse. The store signal 416 provided by the synchronization circuit 404 causes the count value 414 at the output of the 8-bit counter 404 to be clocked or latched into the correction signal generator 412, which in this embodiment, determines whether the count is correct, high, low or out of range. The reason for having a separate store signal 416 and reset signal 410 is because at start up it may not be clear what count the 8-bit counter 402 is starting at. Thus, the store signal 416 is only asserted after a second divided down external reference (i.e., 1 Hz) pulse edge is seen by synchronization circuit 404 thereby ensuring that a full period has been counted before the correction signal generator 412 makes a first correction. After the initial store signal 416 is provided, the reset signal 410 and the store signal 416 are substantially identical.

In various embodiments the synchronization circuit 404 uses NAND gate flip-flops instead of transmission gate flip-flops. As similarly explained above, this is done because the divided down external reference signal on the external reference input 406 and the internal reference signal on the clock input 408 are asynchronous signals making the set up and hold behavior of the flip-flops important. Transmission gate flip-flops have a wider metastable region than NAND gate flip-flops. Using transmission gate flip-flops will increase the probability of the synchronization circuit 404 missing synchronous or near synchronous signal edges of the two input signals, which could result in adding timing errors to the resulting conditioned output signal and the accuracy of the RTC. Thus, embodiments use NAND gate flip-flops which exhibit small metastable regions. The divided down external reference signal passes through two NAND gate flip-flops in series thereby further reducing the probability of metastable behavior being responsible for causing the synchronization circuit 404 and 8-bit counter circuit 402 from operating incorrectly by miscounting or missing a pulse when subjected to synchronous or near synchronous pulses.

Other embodiments of the invention may handle the asynchronous state of the divided down external reference and internal reference signals by using a specific asynchronous logic circuit or a comparator/sample and hold style circuit or other reasonable facsimiles or derivations thereof. Such circuits will help minimized added timing errors associated with missed pulses caused by the asynchronous nature of the two signals. It is understood that missing or adding additional a pulses in a timing circuit degrades the accuracy of the overall RTC over time.

The reset of the counter 402 must be a synchronous reset because as soon as a count is completed within the external divided down signal's period there can be no time delay between the completed count and the beginning of the next count for the next external signal's period (e.g., external 1 Hz signal's period of 1 second).

In some embodiments, the resulting count of the counter 402 may be held in the counter and then latched into the correction signal generator 412 when the store signal 416 is applied to the counter 402 and/or the correction signal generator 412. This is different from the previous embodiment in that the store signal 416 is not instructing the correction signal generator 412 to read a particular one of a changing count value 414 seen on the count value output of the 8-bit counter 402, but instead is latching an accumulated count value from the counter 402 on the store signal 416.

Based on the count value 414 that is received or latched into the correction signal generator 412 when the store signal 416 is active, the correction signal generator determines whether the divided down external reference signal is available and within a predetermined accuracy range. The predetermine accuracy range may be the expected count plus or minus a number of counts that equal the maximum allowable error. If the divided down external reference signal is not available or is outside a predetermined accuracy range then an LOS signal is set on the LOS output 418. Conversely, if the divided down external reference signal is determined to be available and within the predetermined accuracy range, then based on the count value 414 provided to the correction signal generator, the correction signal generator will provide an oscillator-fast signal 418 or oscillator-slow signal 420 to the variable divide by or variable count circuit (not specifically shown).

Embodiments of the invention provide a circuit and method that provides a very low-current solution for a RTC circuit that uses an on-board crystal oscillator to continuously provide a real-time clock timing signal whose accuracy is conditioned, adjusted or maintained with respect to a more accurate external signal when the external signal is available and within a predetermined accuracy range. Furthermore, when the more accurate external signal is unavailable or outside of the predetermined accuracy range, embodiments simply continue to use the on-board oscillator to provide the real-time clock timing signal. Embodiments do not add or subtract timing errors caused by switching between using an available external reference signal and an internal oscillator, when the external reference signal is not available. The internal reference signal provided by the on-board oscillator, is divided down to a 1 Hz frequency while being adjusted or conditioned to maintain accurate timing with respect to the external reference signal when the reference signal is available and accurate to within a predetermined accuracy range. Thus, embodiments of the invention provide a real-time clock signal that is substantially as accurate as an external clock reference, when it is available, or as accurate as an internal oscillator frequency when the more accurate external reference signal is not being used. Through experimentation it has been found that embodiments of the invention require an insignificant amount of current over similar circuitry that does not accept an external reference signal and instead only operates using an on-board or internal crystal oscillator. Thus, embodiments of the invention provide a low cost, low-current (less than 1 microamp) and easy to implement solution for providing a more accurate real-time clock device that uses an internal oscillator, which may be conditioned by an external reference signal, but that does not require additional microcontroller support or special software, does not have timing error additions created due to switching between the use of the internal and external reference oscillation signals or that introduces additive timing errors due to phase differences between the internal and external reference oscillation signals when switching there between. In addition, embodiments of the invention provide a simple technique and means for determining whether an external frequency reference is valid and useable for adjusting or conditioning the timing of the on-board or internal reference oscillator's output.

Furthermore, it should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the concepts and scope hereof, as defined by the following claims. Thus, it is intended that the following claims be interpreted to embrace all such further modifications, changes, rearrangements, substitutions, alternatives, design choices, and embodiments.

What is claimed is:

1. A circuit comprising:

an oscillator circuit configured to provide an internal oscillator signal, the internal oscillator signal comprising internal reference pulse edges substantially at an internal reference frequency;

a frequency counter configured to receive an external reference signal that comprises periodic pulse edges and the internal oscillator signal, the frequency counter further configured to output a count value that represents a number of internal reference pulse edges counted between two external reference signal periodic pulse edges;

a correction signal generator configured to receive the count value, the correction signal generator outputs an oscillator fast signal when the count value is equal to a predetermined first number and outputs an oscillator slow signal when the count value is equal to a predetermined second number, the predetermined first number being greater than the predetermined second number;

a variable divide-by circuit configured to receive the oscillator fast signal, the oscillator slow signal and the internal oscillator signal, the variable divide-by circuit is configured to provide a conditioned output having an output frequency equal to the internal reference frequency divided by a first number when in receipt of the oscillator fast signal, equal to the internal reference frequency divided by a second number when in receipt of the oscillator slow signal, or equal to the internal oscillator reference frequency divided by a third number.

2. The circuit of claim 1, further comprising clock/calendar registers that receive the conditioned output signal.

3. The circuit of claim 2, further comprising a serial bus interface circuit configured to connect to a serial bus and interface with the clock/calendar registers.

4. The circuit of claim 1, wherein the correction signal generator further outputs a loss-of-signal (LOS) indicator when the count value is greater than the first predetermined number or less than the second predetermined number.

5. The circuit of claim 1, wherein the third number is equal to the internal reference frequency.

6. The circuit of claim 1, wherein the frequency counter further comprises a synchronization circuit, the synchronization circuit is configured to receive the external reference signal and the internal oscillator signal, the synchronization circuit configured to pass the external reference signal through two flip-flops connected in series, each flip-flop comprising minimized metastable regions.

7. The circuit of claim 1, wherein the oscillator circuit comprises a crystal oscillator sustaining circuit.

8. The circuit of claim 1, wherein the external reference signal comprises an external reference frequency derived from an external signal, the circuit being adapted to receive the external signal, the external signal comprising an external frequency that is more accurate over time than the internal reference frequency.

9. The circuit of claim 1, wherein the internal reference frequency is 128 Hz.

10. The circuit of claim 1, wherein the frequency counter further comprises a synchronous reset that receives the external reference signal.

11. A real-time clock circuit comprising:

an external clock input adapted to receive an external clock signal;

a divider circuit connected to receive the external clock signal and output an external reference signal comprising an external reference signal frequency of a desired accuracy;

an internal reference signal line connected to provide an internal reference signal having an internal reference signal frequency that is less accurate over time than the desired accuracy, the internal reference signal frequency being higher than the external reference signal frequency; and a synchronization circuit comprising a variable divide-by circuit, wherein during each cycle of the external reference signal, the variable divide-by circuit divides the internal reference signal frequency by a count value to produce a conditioned output signal having a conditioned frequency that over time is substantially as accurate as the desired accuracy, the count value being the number of internal reference signal pulses within one cycle of the external reference signal; and wherein the variable divide-by circuit produces the conditioned output signal by dividing the internal reference signal frequency by a fixed number when the external clock signal is not available.

12. The real-time clock circuit of claim 11, wherein the external clock signal is determined to be not available when the count value is outside of a predetermined count range.

13. The real-time clock circuit of claim 11, further comprising an on-board oscillation circuit configured to provide an oscillator output, the oscillator output being divided down for use as the internal reference signal having substantially the internal reference frequency.

14. The real-time clock circuit of claim 11, wherein the synchronization circuit further comprises a frequency counter connected to receive the internal reference signal and the external reference signal, the frequency counter adapted to provide the count value.

15. The real-time clock circuit of claim 11, wherein the synchronization circuit further comprises a correction signal generator circuit that receives the count value and provides a correction signal indicative of the count value to the variable divide-by circuit.

16. The real-time clock circuit of claim 11, wherein the divider circuit is adapted to divide the external clock input frequency by one of plurality of divisors.

17. The real time clock of claim 11, further comprising a clock/calendar registers that count predetermined increments of time using the conditioned output signal's conditioned frequency as a basic time measurement.

18. A real-time clock circuit comprising:

an oscillation circuit adapted to produce an oscillation signal having an oscillation frequency;

a divide down circuit adapted to receive the oscillation signal and to divide the oscillation signal down and to provide an internal reference signal having an internal reference signal frequency;

a divide circuit adapted to receive an external signal having an external signal oscillation frequency of a desired accuracy, the divide circuit further adapted to divide the external signal oscillation frequency by a selectable number and provide an external reference signal having an external reference frequency, the internal reference signal frequency being less accurate over time than the external reference frequency;

a synchronization circuit adapted to receive both the internal reference signal and the external reference signal, the synchronization circuit counts a count value that equals a number of internal reference signal pulse edges that are within an external reference signal cycle and uses the count value to adjust a divisor of a variable divide-by circuit to produce a corrected output signal, the corrected output signal comprising a corrected output frequency that is substantially as accurate as the desired accuracy.

19. The real-time clock circuit of claim 18, further comprising:

clock/calendar registers that count time based on the corrected output signal frequency; and a serial interface circuit adapted to communicate with an external serial interface and to read from and write clock information to the clock/calendar registers.

20. The real-time clock of claim 18, wherein:

when the count value is a first number the divisor of the variable divide-by circuit is adjusted to divide the internal frequency by the first number;

when the count value is a second number the divisor of the variable divide-by number is adjusted to divide the internal frequency by the second number; or when the count value is less than the first number, greater than the second number, or between the first number and the second number the divisor of the variable divide-by number is adjusted to divide the internal frequency by a third number.

* * * * *